United States Patent [19]

Yasui et al.

[11] Patent Number: 4,773,344

[45] Date of Patent: Sep. 27, 1988

[54] SEWING MACHINE CONTROL DEVICE

[75] Inventors: Hideo Yasui, Tama; Toshiaki Sunada, Chofu, both of Japan

[73] Assignee: Tokyo Juki Industrial Co., Ltd, Tokyo, Japan

[21] Appl. No.: 878,953

[22] PCT Filed: Oct. 18, 1984

[86] PCT No.: PCT/JP84/00492

§ 371 Date: Jun. 11, 1986

§ 102(e) Date: Jun. 11, 1986

[87] PCT Pub. No.: WO86/02391

PCT Pub. Date: Apr. 24, 1986

[51] Int. Cl.[4] ..... D05B 69/26

[52] U.S. Cl. ..... 112/275

[58] Field of Search ..... 112/275, 277, 315, 262.1, 112/121.11, 121.12, 272, 262.3

[56] References Cited

U.S. PATENT DOCUMENTS

| | | | |
|---|---|---|---|
| 4,160,424 | 7/1979 | Newell et al. | 112/275 |
| 4,403,558 | 9/1983 | Martell et al. | 112/275 X |
| 4,513,676 | 4/1985 | Martell et al. | 112/262.1 |
| 4,555,997 | 12/1985 | Tancs | 112/275 X |

*Primary Examiner*—Peter Nerbun

*Attorney, Agent, or Firm*—Tarolli, Sundheim & Covell

[57] ABSTRACT

This invention relates to a sewing machine control device which precisely and effectively stops a sewing machine at the termination point of a seam. The sewing machine control device comprises operation means (LSW) for producing an actuation signal or a stop signal, needle position detector means (NP), workpiece detector means (5, WS) operatively connected to said operation means and an electrical circuit operatively connected to said workpiece detector means. When the operation means drives or stops the sewing machine and the workpiece detector means detects the trailing end edge of a workpiece, the electrical circuit automatically stops the sewing machine.

3 Claims, 4 Drawing Sheets

SEWING MACHINE CONTROL DEVICE

TECHNICAL FIELD

This invention relates to a sewing machine control device and, more particularly, to improvements in a sewing machine control device whereby a sewing machine can be precisely and effectively stopped at the termination point of a seam.

BACKGROUND TECHNOLOGY

In sewing machines generally, it has been known that at the sewing termination point of one of a plurality of continuous sewn portions of a workpiece or at the termination point of the sewing operation for all the sewn portions, the sewing machine must be precisely stopped so that the seam or seams will not deviate from the end of the workpiece.

Hithertofore, a variety of methods for stopping sewing machines in such a manner have been attempted.

According to the first method, when a seam is formed to finish at a position adjacent to an end edge of a workpiece where the sewing operation is scheduled to terminate, the operator reduces the force applied to the pedal so that the sewing machine is driven at a low speed, stops the machine when the seam reaches the predetermined sewing termination point and then depresses the pedal again to effect thread cutting. However, this method requires that the operator controls the pedal with great care. According to the second method, a workpiece detector means utilizing light is disposed upstream of the sewing zone in the sewing machine in the workpiece feed direction and the sewing machine stops automatically as the trailing end edge of a workpiece passes by the workpiece detector means independently of the pedal control. However, this method involves the drawback that when a seam is formed along an end edge of a workpiece having a complicated configuration such as a wave or concavo-convex shape, for example, the workpiece end edge tended to deviate at concavo-convex corners thereof from its proper position with respect to the workpiece detector means whereby the sewing machine is inadvertently stopped. This results in a substantial reduction of operation efficiency.

According to the third method, when a workpiece detector means detects the trailing end edge of a workpiece, the sewing machine stops and a thread cutter means is operated. However, this method involves the drawback that when a seam is formed along an end edge of a piece of cloth having a complicated configuration or of a piece of cloth having a square configuration such as a neck, collar, sleeve or cuff, each time the workpiece end edge deviated at a corner of square or concavo-convex configuration from its proper position with respect to the workpiece detector means, the sewing machine stops and the thread cutter means is operated, thereby making it impossible to form a continuous seam along the workpiece end edge and impairing the quality of a sewn product.

DISCLOSURE OF THE INVENTION

The purpose of the present invention is to provide a sewing machine control device which eliminates the drawbacks inherent in the prior art.

According to the present invention, in order to attain this purpose the sewing machine is driven or stopped in response to the operation of the pedal and when a workpiece detector means disposed upstream of the sewing zone in the machine in the workpiece feed direction detects the trailing end edge of a workpiece, the sewing machine is automatically stopped independently of the above-mentioned operation of the pedal.

BEST MODE FOR CARRYING OUT THE INVENTION

Figure 1:
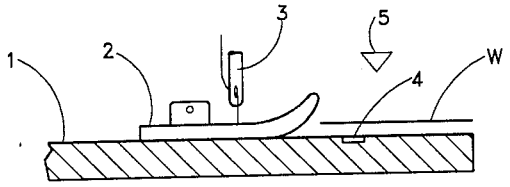
FIG. 1 is a schematic front elevational view of the sewing zone in a sewing machine embodying the present invention.

First referring to FIG. 1, there is schematically shown a portion of a sewing machine to which the sewing machine control device according to the present invention is applied.

In FIG. 1, 1 denotes the throat plate, 2 denotes the workpiece holding-down foot which is adapted to be resiliently pressed against the throat plate 1 and to pinch a workpiece W in cooperation with a workpiece feed dog (not shown), 3 denotes a needle adapted to move upwardly and downwardly in response to the rotation of the sewing machine main shaft (not shown), 4 denotes a reflector plate secured to the upper surface of the throat plate 1 upstream of the workpiece holding-down foot 2 in the workpiece feed direction and 5 denotes a workpiece detector means disposed above and spaced apart from the throat plate 1. The workpiece detector means 5 comprises a light emitting portion (not shown) for emitting light to the reflector plate 4 and a light receiving portion (not shown) for receiving the light reflected from the reflector plate to produce an absence-of-workpiece signal when the workpiece W is not present between the reflector plate 4 and detector means 5 and a presence-of-workpiece signal when the detector means is shielded from the reflector plate 4 when the workpiece is present therebetween. Although not shown, the sewing machine is provided with a thread cutter means disposed below the throat plate 1 and operable while the needle 3 is rising from the bottom dead point by the operation of an operation means such as an electromagnet to arrest and cut upper and lower threads attached to the workpiece W, and a needle position detector means (NP in FIG. 5) so disposed relative to the main shaft of the sewing machine that as the main shaft rotates to move the needle 3 upwardly and downwardly, the needle detector means detects the rotational angles of the main shaft corresponding to upper and lower positions of the needle 3 respectively, and produces position signals representing the positions of the needle.

Figure 3:
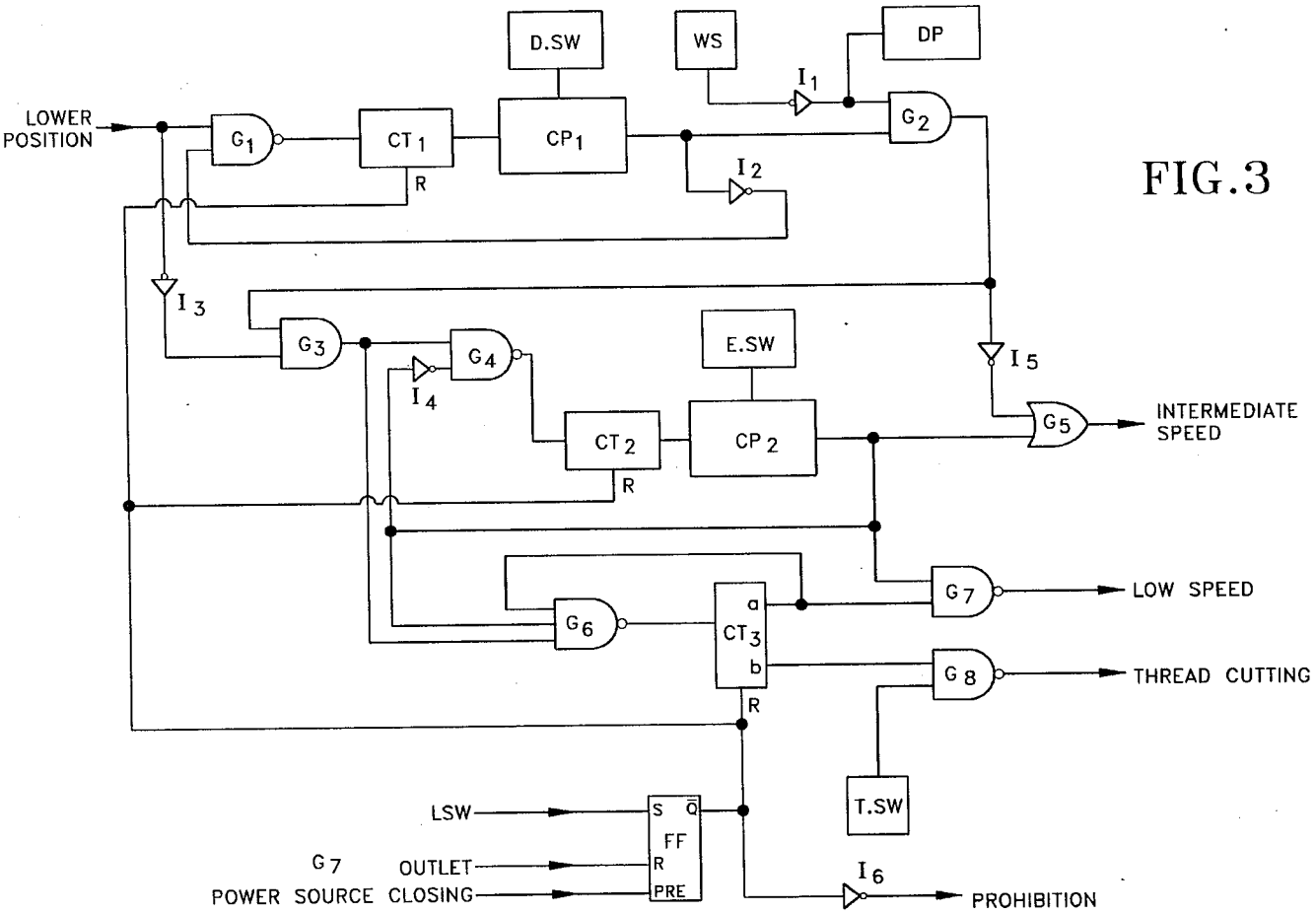
FIG. 3 is a block diagram of the main electrical circuit in the embodiment.

An electrical circuit is provided for controlling the sewing machine and this electrical circuit is shown in FIG. 3. In FIG. 3, WS denotes a detector circuit incorporated in the light receiving section of the workpiece detector means 5 and adpated to produce an L level or absence-of-workpiece signal in its light receiving condition and an H level or presence-of-workpiece signal in its shielded condition, DP denotes a display circuit including a lamp adapted to be energized when a presence-of-workpiece signal is produced, $CT_1$, $CT_2$ denote counter circuits adapted to count up and down edges of signals having a rectangular wave form and coming from gate circuits $G_1$, $G_4$, respectively, DSW denotes a number-of-nullifying-stitches setting switch set to numeral values in the range of 0–99, for example, to set numbers of stitches which nullify detection signals from the detector circuit WS, and ESW denotes a number-of-stitches-up to-stop setting switch settable to numeral values in the range of 0–9 and adapted to set the number of stitches to be sewn from the time when the end of the seam on the workpiece W has been detected based on a detection signal from the detector circuit WS to the time when the sewing machine stops.

$CP_1$, $CP_2$ denote comparator circuits adapted to compare a count on the counter $CT_1$ with a value set on the switch DSW and a count on the counter $CT_2$ with a value set on the switch ESW, respectively, and when counts on the counters coincide with the respective values set on the associated switches, the comparator circuits $CP_1$ and $CP_2$ produce coincidence signals of H level. $CT_3$ denotes a counter circuit having outputs a and b in which the output a produces an output signal of L level while the numeral values of 0–2 are being counted whereas the output b produces an output signal of L level while the numeral values of 0 and 1 are being counted. TSW denotes a switch adapted to set the thread cutting at the termination of sewing as either valid or null and to produce an output of H level at the time of valid thread cutting. FF denotes a positive edge type flip-flop adapted to be preset at the time of power source closing, reset by the up-edge of a signal having a rectangular wave form from the gate circuit $G_7$ and set by the up-edge of a signal having a rectangular wave form from a pedal switch LSW, an explanation of which will be made hereinafter.

$G_1$–$G_8$ denote gate circuits and $I_1$–$I_6$ denote inverter circuits. The NAND gate circuit $G_1$ remains open while the comparator circuit $CP_1$ is producing an anticoincidence signal, allows a lower position signal from the needle position detector means NP to pass through the gate circuit $G_1$ to provide an output of L level which is then input to the counter $CT_1$ and closes when the comparator circuit $CP_1$ produces a coincidence signal. The AND gate $G_2$ provides an output of H level when the detector circuit WS produces an absence-of-workpiece signal and the comparator circuit $CP_1$ produces a coincidence signal, the AND gate opens to allow a lower position signal to pass therethrough when the gate $G_3$ circuit $G_2$ provides an output of H level and the NAND gate circuit $G_4$ remains open to allow a lower position signal to pass therethrough while the comparator circuit $CP_2$ is producing an anticoincidence signal to input the signal to the counter $CT_2$ and closes when the comparator circuit $CP_2$ produces a coincidence signal. The OR gate circuit $G_5$ produces an intermediate speed setting signal of L level during the time duration from the time at which the detector circuit WS produced an absence-of-workpiece signal (since the gate circuit $G_2$ has produced an output of H level) to the time at which the comparator circuit $CP_2$ produces a coincidence signal. The NAND gate circuit $G_6$ remains open during the time duration from the time at which the comparator circuit $CP_2$ produced a coincidence signal to the time at which the counter $CT_3$ produces an output of H level at its output a to allow an output of the gate circuit $G_3$ (a lower needle position signal) to pass therethrough to be input to the counter $CT_3$. The NAND gate $G_7$ produces a low speed setting signal during the time duration from the time at which the comparator circuit $CP_2$ produced a coincidence signal to the time at which the output a of the counter $CT_3$ counts "2".

Figure 5:
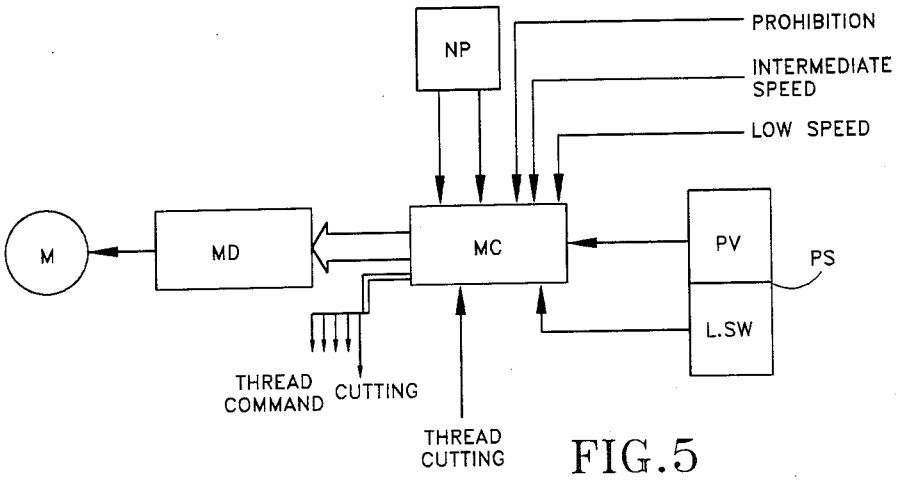
FIG. 5 is a diagram of the control circuit of the motor and sewing machine operation means in the embodiment.

In FIG. 5, M denotes a sewing machine motor operatively connected to the main shaft of the sewing machine and, in the illustrated embodiment, the machine motor is in the form of an electromagnetic clutch motor. NP denotes the above-mentioned needle position detector means which is adapted to detect rotational angles of the main shaft corresponding to upper and lower positions of the needle to produce upper and lower position signals of L level. PS denotes an operation detector means associated with the pedal (not shown) of the sewing machine and comprising a pedal switch LSW adapted to produce an L level signal upon the actuation or depression of the pedal and an H level signal upon the release of the pedal and an operation detection section PV adapted to produce a speed setting signal the value of which varies in proportion to variations in the amount by which the pedal is depressed relative to its fully released position. MD denotes a motor drive circuit adapted to drive and stop the motor M and MC denotes a microcomputer adapted to control the drive circuit MD and also the machine operation means for the thread cutting operation and the like.

Figure 6:
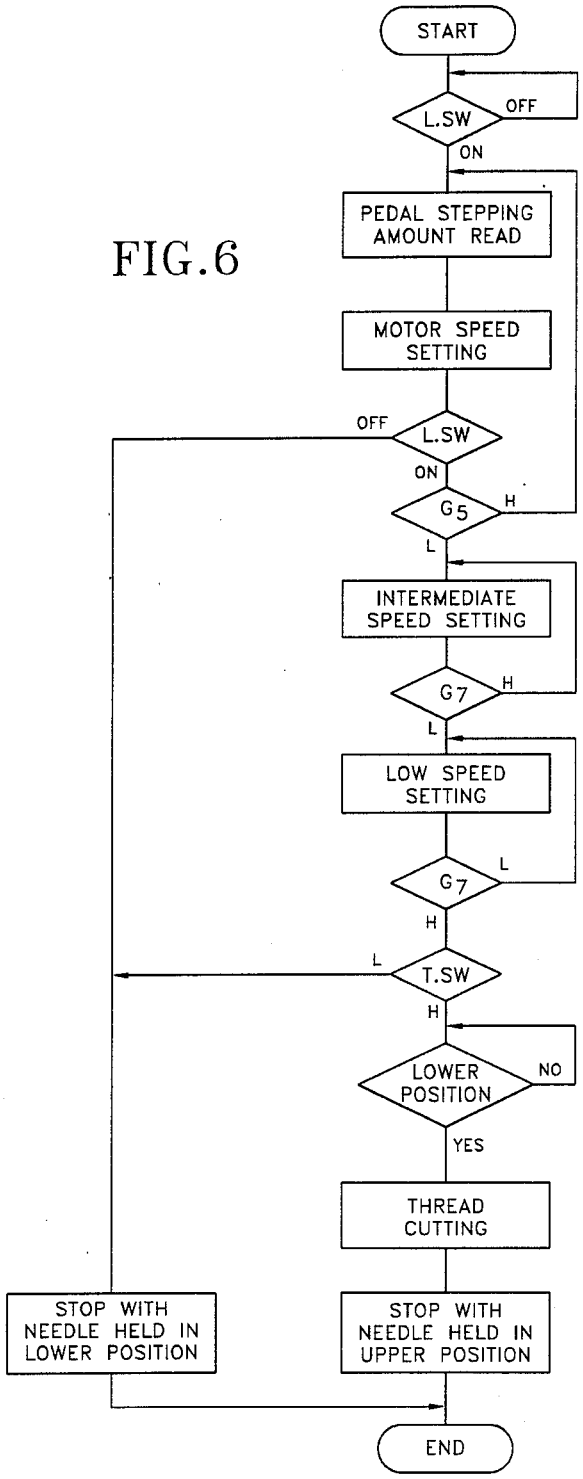
FIG. 6 is a flow chart for controlling the motor and thread cutter.

The microcomputer MC controls the motor and thread cutter means in accordance with the flow chart of FIG. 6.

In operation, it is first of all determined whether the pedal switch LSW is in its ON or OFF condition; when the switch is in its ON condition, the amount by which the pedal is depressed or the value of the signal from the detection section PV is read and the drive circuit MD is commanded to drive the motor at a speed corresponding (in proportion) to that amount or value. Next, the condition of the pedal switch LSW is again determined and when it has been determined that the switch is in its OFF condition, a lower position signal is produced to operate the "stop-in-lower position subroutine" for controlling the motor M so as to stop the sewing machine with the needle disposed at its predetermined lower position. Alternatively, when the pedal switch LSW is in its ON condition, the output of the gate circuit $G_5$ is determined and when the gate circuit $G_5$ produces an intermediate speed setting signal (L level), the drive circuit MD is commanded to drive the motor M at a predetermined intermediate speed. Next, the output of the gate circuit $G_7$ is determined and when the gate circuit produces a low speed setting signal (L level), the drive circuit MD is commanded to drive the motor M at a predetermined low speed (capable of instantly stopping the sewing machine) and the output of the gate circuit $G_7$ is again determined. When the output of the gate circuit $G_7$ rises, the condition of the pedal switch TSW is determined and when it has been determined that the switch is in its invalidation-of-thread cutting condition (L level), an upper position signal is produced to operate the "stop-in-upper position subroutine" and thus to control the motor M so as to stop the sewing machine with the needle disposed in its predetermined upper position. When the pedal switch TSW is in its valid (H level) condition, it is determined whether a lower position signal is being produced and whether the output of the gate circuit $G_8$ is L level. When both these conditions are satisfied, a thread cutting command is produced to operate the thread cutter means and thereafter the "stop-in-upper position subroutine" is operated.

Figure 2:
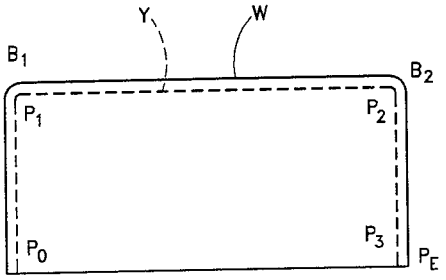
FIG. 2 is an explanatory view showing the formation of a seam on a workpiece W by the embodiment of FIG. 1.

With the above-mentioned construction and arrangement of the components of the sewing machine control device of the present invention, the operation of the control device will now be described by referring to the instance in which a seam Y is formed along the side and end edges of a substantially rectangular workpiece W as shown in FIG. 2. The number-of-invalid-stitches setting switch DSW is set to a numeral value corresponding to the number of stitches expected to be sewn from the sewing initiation point $P_0$ to the point $P_3$ short of the sewing termination point $P_e$, for example "70", and the number-of-stitches-upto-stop setting switch E is set to the numeral value corresponding to the number of stitches expected to be sewn from the time when the trailing end of the workpiece W has moved to the workpiece detector means 5 and an absence-of-workpiece signal has been produced to the position three stitches short of the sewing termination point $P_e$, for example, "6".

Figure 4:
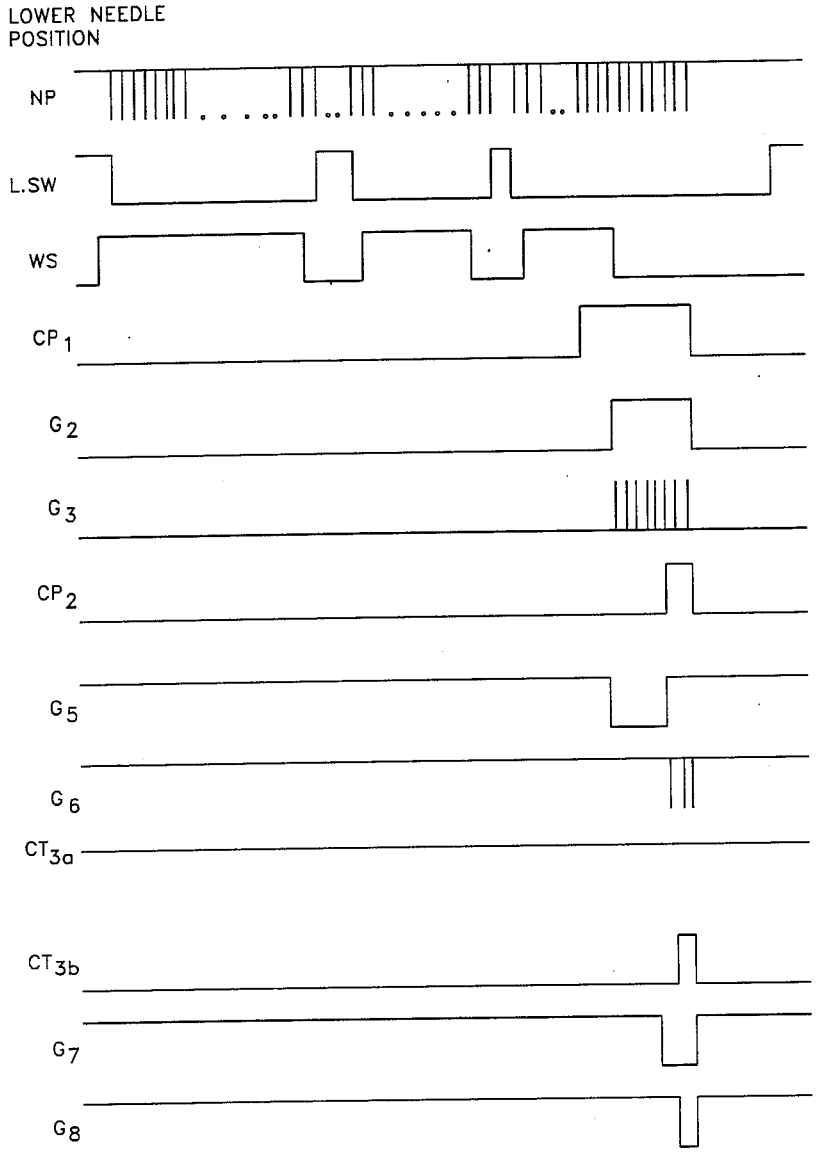
FIG. 4 is a time chart of the electrical circuit of FIG. 3.

Next, when the point $P_0$ on the workpiece W is disposed in the position opposite to the needle drop point as shown in the time chart of FIG. 4 and the flow chart of FIG. 6, the workpiece detector means 5 (WS) produces a presence-of-workpiece signal (H level) and when the pedal is depressed, the pedal switch LSW turns on to produce an output of L level. The sewing machine motor M is driven at a speed based on the value determined by the detection section PV of the operation detector means PS which relates to the amount of pressure on the pedal. The counter $CT_1$ has input thereto lower position signals from the needle position detector means NP which are produced as the main shaft of the sewing machine rotates through the gate circuit $G_1$ and counts the signals. When the sewing operation has proceeded to the point $P_1$ at the first corner of the workpiece, since the workpiece detector means 5 is positioned upstream of the needle drop point in the workpiece feed direction, the workpiece detector means 5 is positioned at the point $B_1$ outwardly of the workpiece W and an absence-of-workpiece signal is produced, but since the count of the counter $CT_1$ does not coincide with the set value, the comparator circuit $CP_1$ provides an output of L level, the gate circuit $G_2$ remains unchanged and accordingly, the output of the workpiece detector means 5 is nullified. At the point $P_1$, the pedal is released to turn the pedal switch LSW off whereby the sewing machine (motor M) stops with the needle disposed in a lower position in accordance with the "stop-in-lower position subroutine".

When the pedal is depressed after the workpiece W has been rotated about the needle 3 so that the sewing operation has proceeded to the point $P_2$ at the second corner of the workpiece, the sewing machine is similarly driven. At the point $P_2$, the sewing machine is similarly stopped and thereafter, when the pedal is again depressed after the workpiece W has been similarly turned, the sewing machine is driven and the sewing operation proceeds towards the termination point $P_e$.

At the point $P_3$ between the point $P_2$ and termination point $P_e$, since the number of stitches is 70 and the count of the counter $CT_1$ coincides with the value set on the setting switch DSW, the comparator circuit $CP_1$ produces a coincidence signal of H level which closes the gate circuit $G_1$ and opens the gate circuit $G_2$. When the sewing operation has proceeded to a position short of the termination point $P_e$, the trailing end of the workpiece W moves from a proper detected position relative to the workpiece detector means 5 and an absence-of-workpiece signal is produced to cause the gate circuit $G_2$ to provide an output of H level and open the gate circuit $G_3$ whereupon the signal is inverted by the inverter $I_5$ and input to the gate circuit $G_5$, and since the coincidence circuit $CP_2$ provides a L level output, the gate circuit $G_5$ provides an L level output. Since the L level output of the gate circuit $G_5$ is an intermediate speed setting signal, the microcomputer MC provides an intermediate speed command to the drive circuit MD which drives the sewing machine (motor M) at an intermediate speed. Since the gate circuit $G_3$ is open at this time, when a lower position signal is produced, the gate circuit $G_3$ provides an H level output which is input through the gate circuit $G_4$ to the counter $CT_2$ which then commences counting. When the counter $CT_2$ counts the number of six stitches, since the count coincides with the setting value of the setting switch ESW, the comparator circuit $CP_2$ produces a coincidence signal of H level which closes the gate circuit $G_4$ and is input to the gate circuits $G_6$, $G_7$. Since the output a of the counter $CT_3$ is at H level while the counter is counting 0–2, the gate circuit $G_7$ is open and produces an L level output (low speed setting signal) in response to a coincidence signal from the comparator circuit $CP_2$ and the microcomputer MC provides a low speed command to the drive circuit MD to drive the sewing machine (motor M) at a low speed. And since the gate circuit $G_6$ opens in response to the coincidence signal, the gate cirucit is at L level when a lower position signal is produced and the counter $CT_3$ commences counting. When the counter $CT_3$ counts a lower position signal of the count of two stitches, the output b of the counter is at H level. When the switch TSW is set for effective thread cutting, the gate circuit $G_8$ produces an L level output (thread cutting signal) and the thread cutter operation means operates upon the generation of a next lower position signal and the "stop-in-upper position subroutine" operates. Thread cutting is carried out while the needle 3 is rising and the sewing machine stops with the needle disposed in an upper position. When the counter $CT_3$ counts lower position signals, since the output a of the counter is at L level, the output of the gate circuit $G_7$ is at H level to reset the flip-flop FF to make the terminal Q of the flip-flop FF H level and reset the counters $CT_1$, $CT_2$ and $CT_3$ and nullifies the ON output of the pedal switch LSW with the pedal held in its depressed condition.

In the above-mentioned embodiment, although the workpiece detector means is shown as being photosensitive, the detector means may be of a type which is not photosensitive.

According to the present invention, there are provided an operation circuit which drives the motor in response to an actuation signal and stops the motor in response to change from a presence-of-workpiece signal to an absence-of-workpiece signal or a stop signal, a digital count circuit which produces an operation signal when a certain number of position signals has been counted which corresponds to the number of stitches sewn upto a position short of the sewing termination end edge of the workpiece, and a regulator circuit which interrupts at a point between the workpiece detector means and the operation circuit during the time duration from the moment at which an actuation signal is produced to the moment at which an operation signal is produced. Thus, even when the workpiece deviates from the workpiece detector means at its trailing end where the sewing operation terminates, the sewing machine will not stop inadvertently and the thread cutter means will not operate inadvertently either. Therefore, even when seams are formed along an end edge having a complicated configuration, the operator can perform the sewing operation safely by suitable control of the pedal to thereby improve operation efficiency. Furthermore, since the sewing machine will not stop inadvertently nor the thread cutter means operate inadvertently, the present invention exhibits the practical advantage that the quality of a sewn product can be improved by forming a continuous seam along end edges of a workpiece.

We claim:

1. An apparatus for use in sewing a workpiece, said apparatus comprising means for reciprocating a needle to stitch the workpiece in a sewing zone, said means including a motor which is operable at any one of a plurality of speeds to effect reciprocation of the needle at any one of a plurality of speeds and means for effecting relative movement between the workpiece and needle to move the sewing zone relative to the workpiece as the workpiece is stitched, first circuit means for counting a first predetermined number of stitches and providing a control signal in response to the counting of the first predetermined number of stitches, detector circuit means for providing a control signal in response to movement of the sewing zone to within a predetermined distance of an edge portion of the workpiece, and control means connected with said motor, first circuit means and detector circuit means for reducing the speed of operation of said motor from a relatively high speed to an intermediate speed in response to a control signal from said detector circuit means after a control signal has been provided by said first circuit means, said control means including means for rendering said control means ineffective to reduce the speed of operation of said motor to the intermediate speed in response to a control signal from said detector circuit means prior to the counting of the first predetermined number of stitches by said first circuit means to prevent said control means from reducing the speed of operation of said motor in response to the detection of an edge portion of the workpiece by said detector circuit means prior to the stitching of the first predetermined number of stitches, second circuit means for counting a second predetermined number of stitches and providing a control signal in response to the counting of the second predetermined number of stitches, said control means including means for initiating the counting of the second predetermined number of stitches simultaneously with the reduction in the speed of operation of said motor to the intermediate speed and means for reducing the speed of operation of said motor from the intermediate speed to a lower speed in response to a control signal from said second circuit means, and third circuit means for counting a third predetermined number of stitches, said control means including means for initiating the counting of the third predetermined number of stitches simultaneously with the reduction in the speed of operation of said motor to the lower speed and means for initiating a control function in response to the counting of the third predetermined number of stitches.

2. An apparatus for use in sewing a workpiece, said apparatus comprising means for reciprocating a needle to stitch the workpiece in a sewing zone, said means including a motor which is operable at anyone of a plurality of speeds to effect reciprocation of the needle at anyone of a plurality of speeds and means for effecting relative movement between the workpiece and needle to move the sewing zone relative to the workpiece as the workpiece is stitched, first circuit means for counting a first predetermined number of stitches and providing a control signal in response to the counting of the first predetermined number of stitches, detector circuit means for providing a control signal in response to movement of the sewing zone to within a predetermined distance of an edge portion of the workpiece, and control means connected with said motor, first circuit means and detector circuit means for reducing the speed of operation of said motor from a relatively high speed to an intermediate speed in response to a control signal from said detector circuit means after a control signal has been provided by said first circuit means, said control means including means for rendering said control means ineffective to reduce the speed of operation of said motor to the intermediate speed in response to a control signal from said detector circuit means prior to the counting of the first predetermined number of stitches by said first circuit means to prevent said control means from reducing the speed of operation of said motor in response to the detection of an edge portion of the workpiece by said detector circuit means prior to the stitching of the first predetermined number of stitches, second circuit means for counting a second predetermined number of stitches and providing a control signal in response to the counting of the second predetermined number of stitches, said control means including means for initiating the counting of the second predetermined number of stitches simultaneously with the reduction in the speed of operation of said motor to the intermediate speed and means for reducing the speed of operation of said motor from the intermediate speed to a lower speed in response to a control signal from said second circuit means, and third circuit means for counting a third predetermined number of stitches and providing a control signal in response to the counting of the third predetermined number of stitches, said control means including means for initiating counting of the third predetermined number of stitches simultaneously with the reduction in the speed of operation of said motor to the low speed and means for initiating the cutting of a thread connected with the needle in response to a control signal from said third circuit means.

3. A sewing machine control device comprising:

a motor (M) operatively connected to the main shaft of a sewing machine for driving and stopping said main shaft;

operation means (LSW) adapted to cause said motor to produce an actuation signal during the actuation of said sewing machine and a stop signal during the stopping of said sewing machine;

needle position detector means (NP) operatively connected to said operation means and adapted to produce a position signal by detecting a particular rotational angle of said sewing machine main shaft;

workpiece detector means (5, WS) operatively connected to said needle position detector means in opposition to a workpiece movement path in a position upstream of the sewing zone of said sewing machine in the workpiece feed direction and adapted to produce an absence-of-workpiece signal by detecting the absence of a workpiece; and an electrical circuit operatively connected to said workpiece detector means, said electrical circuit having: an operation circuit adapted to drive said motor in response to an actuation signal and stop said motor in response to an absence-of-workpiece signal; a digital count circuit adapted to produce an operation signal when the number of position signals which has been counted corresponds to the number of stitches sewn up to a position short of the sewing termination edge of said workpiece; and a regulator circuit adapted to interrrupt operation of said motor during the time duration from the moment when said actuation signal is produced to the moment when said operation signal is produced; said regulator circuit including means for counting a predetermined number of stitches, means for initiating the counting of the predetermined number of stitches simultaneously with a reduction in the speed of operation of said motor to a lower speed and means for initiating a control function in response to the counting of the predetermined number of stitches.

* * * * *